US007055823B2

(12) United States Patent
Denkewicz, Jr.

(10) Patent No.: US 7,055,823 B2
(45) Date of Patent: Jun. 6, 2006

(54) CARDS

(76) Inventor: Raymond P. Denkewicz, Jr., 12 Park View Pl., Pound Ridge, NY (US) 10576

( * ) Notice: Subject to any disclaimer, the term of this patent is extended or adjusted under 35 U.S.C. 154(b) by 0 days.

(21) Appl. No.: 10/303,393

(22) Filed: Nov. 25, 2002

(65) Prior Publication Data

US 2003/0227136 A1 Dec. 11, 2003

Related U.S. Application Data

(60) Provisional application No. 60/334,449, filed on Nov. 29, 2001.

(51) Int. Cl.
*A63F 1/00* (2006.01)

(52) U.S. Cl. ..... 273/304; 273/292; 273/302; 273/303; 273/308; 273/429; 434/331; D21/376

(58) Field of Classification Search ..... 273/292, 273/302–308, 139, 429; 434/327, 129, 331, 434/346; D21/376
See application file for complete search history.

(56) References Cited

U.S. PATENT DOCUMENTS

| | | | | | |
|---|---|---|---|---|---|
| 2,162,946 | A * | 6/1939 | Garrison | 273/304 |
| 3,068,010 | A * | 12/1962 | Hagopian | 273/295 |
| 3,281,960 | A * | 11/1966 | Gross | 434/331 |
| 3,327,406 | A * | 6/1967 | Baker | 434/327 |
| 3,524,645 | A * | 8/1970 | Breslow | 273/292 |
| 3,918,174 | A * | 11/1975 | Miller et al. | 434/346 |
| 5,112,059 | A * | 5/1992 | Mundle et al. | 273/292 |
| 5,314,197 | A * | 5/1994 | Hersch | 273/430 |
| 5,690,336 | A * | 11/1997 | Oliver | 273/302 |
| 6,099,318 | A * | 8/2000 | McLeod et al. | 434/129 |
| D457,571 | S * | 5/2002 | Edwards, Jr. | D21/376 |
| 6,412,779 | B1 * | 7/2002 | Kenney | 273/292 |
| 2004/0017042 | A1 * | 1/2004 | Piernas | 273/273 |

FOREIGN PATENT DOCUMENTS

GB 2286131 A * 8/1995

* cited by examiner

*Primary Examiner*—Benjamin Layno
(74) *Attorney, Agent, or Firm*—Gerow D. Brill

(57) ABSTRACT

The present invention relates to educational and entertaining playing cards. The cards may be used alone or in combination with other hardware game accessories, such as board games, or software game accessories, such as compact discs and the Internet. Unlike other popular and heavily traded playing cards (e.g. Pokemon) which have limited social and educational value, an educational element has been added to the cards of the present invention without destroying the fun associated with the collecting, trading, and playing of the cards. Educational facts and information about a variety of topics are located on the playing cards, which may be used to play various games. Two different types of game cards are contemplated by the present invention: (1) standard cards and (2) fact cards. The present invention, however, is in no way limited to only these two types of game cards.

20 Claims, 5 Drawing Sheets

CARDS

CROSS REFERENCE

This application is related to provisional patent application 60/334,449 filed on Nov. 29, 2001 entitled Cards and is hereby incorporated by reference.

SUMMARY OF THE INVENTION

The present invention relates to educational and entertaining playing cards. The cards may be used alone or in combination with other hardware game accessories, such as board games, or software game accessories, such as compact discs and the Internet. Unlike other popular and heavily traded playing cards (e.g. Pokemon) which have limited social and educational value, an educational element has been added to the cards of the present invention without destroying the fun associated with the collecting, trading, and playing of the cards. Educational facts and information about a variety of topics are located on the playing cards, which may be used to play various games.

Two different types of game cards are contemplated by the present invention: (1) standard cards and (2) fact cards. The present invention, however, is in no way limited to only these two types of game cards.

BRIEF DESCRIPTION OF THE DRAWINGS

These and other features, aspects, and advantages oft he present invention will become better understood with regard to the following description, appended claims, and accompanying drawings where:

DETAILED DESCRIPTION OF THE INVENTION

The present invention relates to educational and entertainment uses of playing cards. There are several embodiments for the instant invention including: standard cards; fact cards; computer games; a board; and trading cards.

(1) Standard Cards (see FIGS. 1–4)

As with any ordinary deck of cards, in a preferred embodiment at least fifty-two standard cards are provided. The fifty-two standard cards may be divided equally into four categories and numbered "1" to "13" within each category. The four categories may be analogous to the four suits in a standard deck of cards (Hearts, Clubs, Spades, and Diamonds) and the 1–13 designation on the cards may be analogous to the 2–10, Jack, Queen, King, and Ace designation on the cards of a standard deck. However, those skilled in the art will recognize that the deck may contain more or fewer than fifty-two cards and that such cards need not necessarily be divided either equally or into four categories and may be numbered or otherwise labeled or marked differently than heretofore described.

Figure 1:
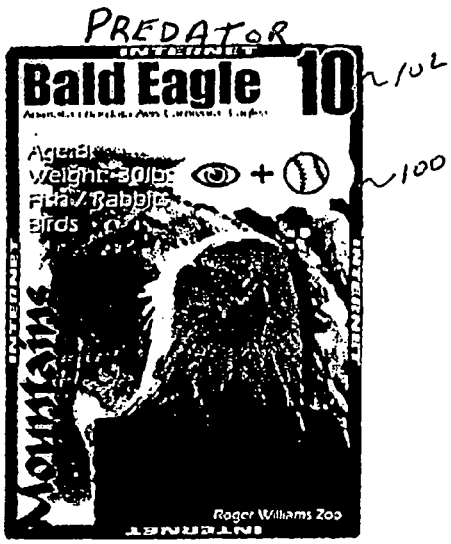
FIGS. 1–4 illustrate a first embodiment having standard cards.
Figure 2:
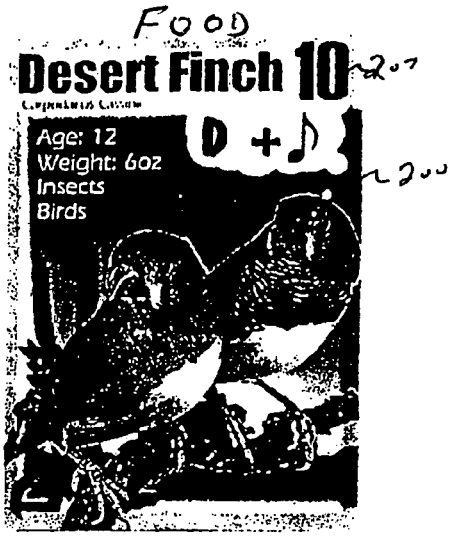
Figure 3:
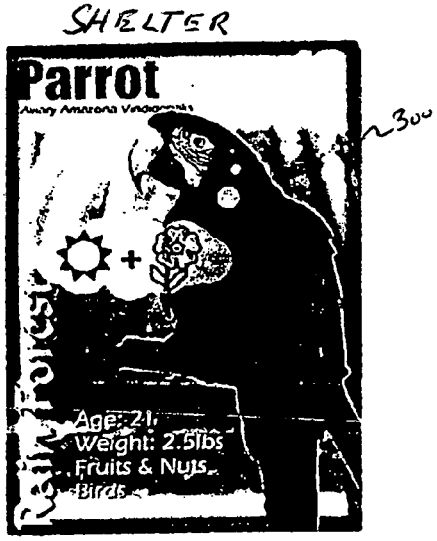
Figure 4:
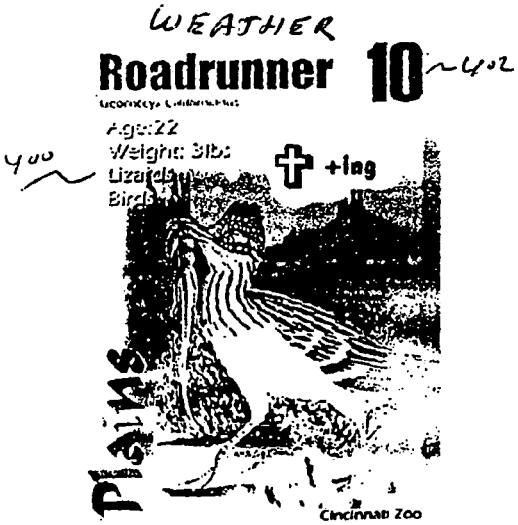

Each standard card within a category may contain pictures, descriptions, and other interesting factual information about that category. It is preferable but not required that all of the categories of the standard cards be related so that the cards have a common theme. For example, each of the four categories could be a different food group (e.g. Breads and Grains, Dairy, Fruit and Vegetables, Meats and Proteins) and each card within each category could highlight a different food within that food group. Alternatively, each of the four categories could be a different continent (e.g. Africa, Australia, Asia and Europe) and each card within each category could highlight a different city within that continent. Those skilled in the art will recognize that the themes for the various card categories can be drawn from a myriad of subjects, including, but not limited to, Astronomy, Biology, Physiology, Languages, Types of Wine, Sports, Modes or Transportation, Materials, Colors, Cars, Zoology, etc. For purposes of discussion and illustration, the categories of the cards of a preferred embodiment of the present invention are different animal habitats (e.g., Mountains, Desert, Rain Forest, and Plains) and each card within each category contains pictures, descriptions, and other interesting factual information about a different animal living within that habitat (e.g., in FIG. 1 a Bald Eagle 100, in FIG. 3 a Desert Finch 200, in FIG. 3 a Parrot 300, and in FIG. 4 a Roadrunner 400, respectively). In a further embodiment, the content and numbering of the cards may be designed in a manner that the cards that are numbered the same (e.g. the number "10" cards as shown in FIGS. 1,2 and 4 as 102, 202 and 402 respectively) have related subject matter across all categories (e.g. all the number 10 cards could be types of snakes).

In addition to the fifty-two numbered standard cards, additional standard cards containing information about different animals within one of the four habitats or, alternatively, introducing new habitats (e.g. Ocean, Polar, Tundra, etc.) and highlighting animals living within those new habitats, may be provided. These additional standard cards typically should not be numbered so that the user may readily identify the standard cards (i.e., the numbered ones) to be used in connection with standard deck card games. Again, however, these additional cards (if present) may contain different information than described above and may indeed be numbered if appropriate or desired.

Figure 5:
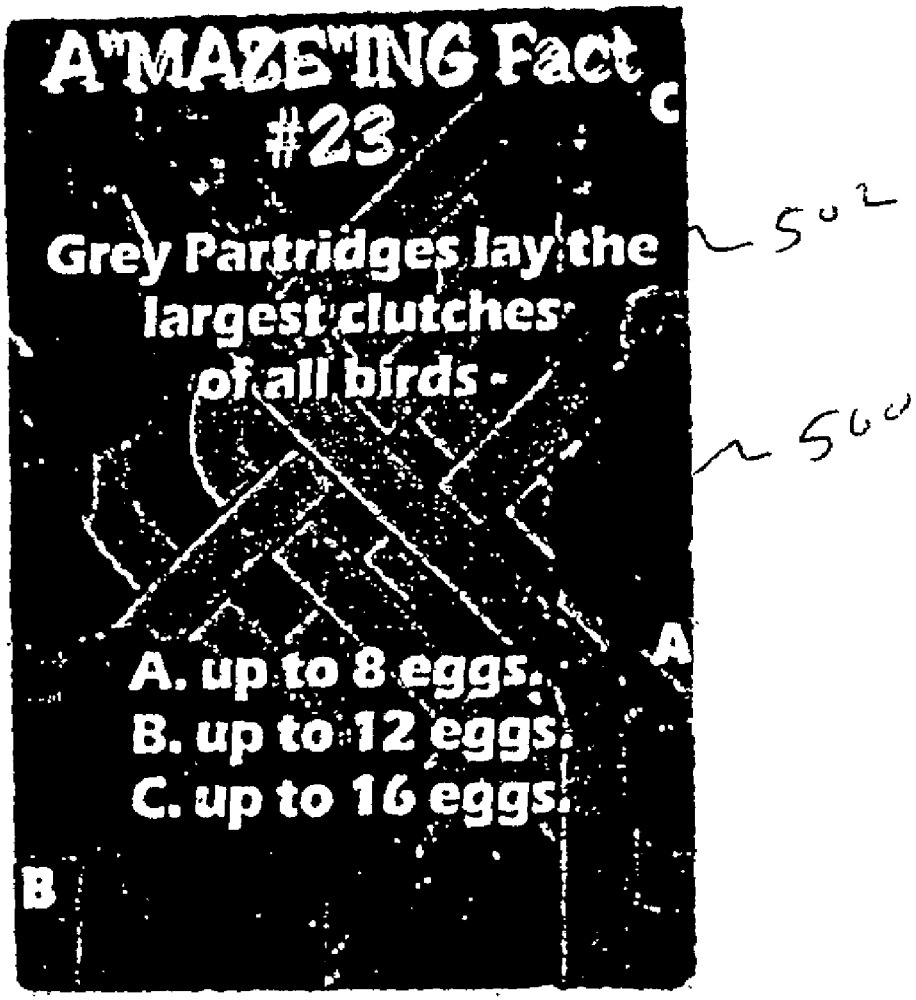
FIG. 5 illustrates a second embodiment having fact cards.

(2) Fact Cards (see FIG. 5)

Figure 6:
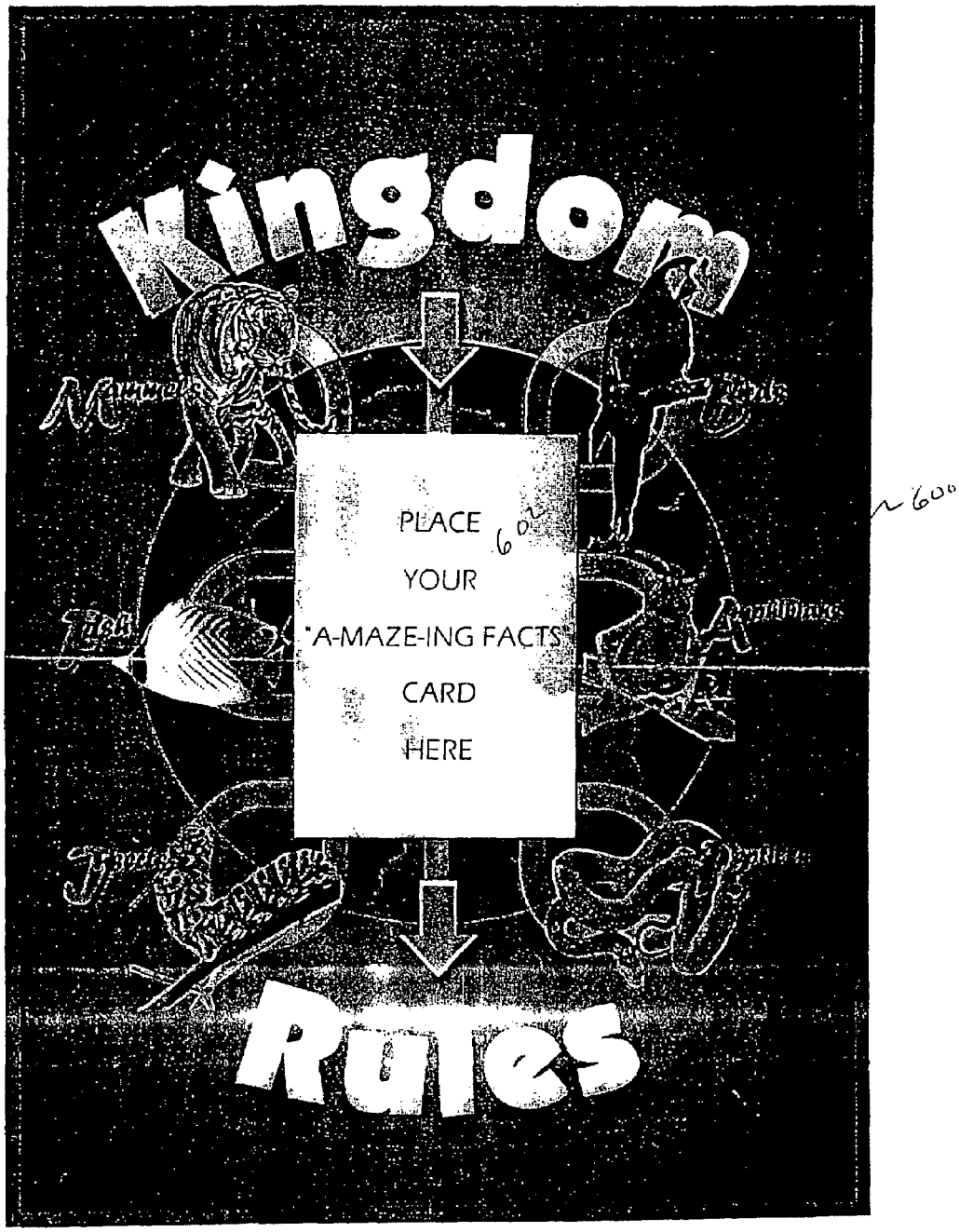
FIG. 6 illustrates a special decoder.
Figure 7:
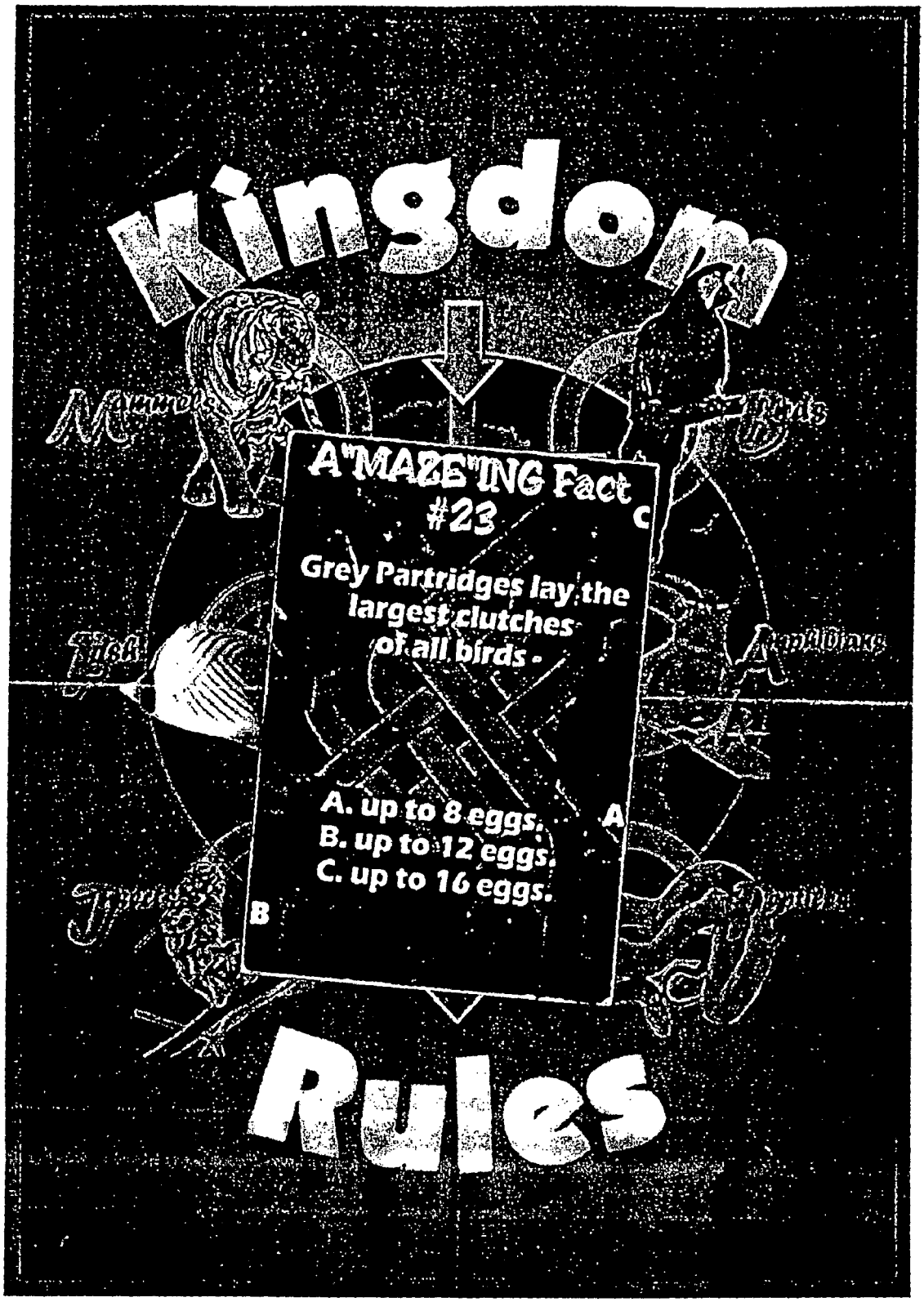
FIG. 7 illustrates following an arrow through maze.

In addition to the standard cards, fact cards containing interesting trivia information or questions may be provided as a supplementary education tool. It is preferable, but not required, that the trivia information 502 relate to the subject matter of the standard cards (i.e., in this example, the trivia questions relate to animals within the different Habitats) so that the cards have a common theme as shown in FIG. 5 500. To enhance the appeal of answering the trivia questions, the answers on the fact cards are preferably, but do not have to be, hidden or disguised in a manner that requires deciphering or decoding. Masking of the answer may be done in numerous ways. For example, the correct answer may be a three-dimensional ("3-D") image on the card and therefore require the user to don 3-D glasses to identify the correct answer. Alternatively, the answer could be hidden under a surface coating that must be "scratched off" (like a lottery ticket). Or, alternatively, a special decoder 600 (see FIG. 6) may be used to identify the correct answer to the question by positioning the fact card 602 on the decoder and following the arrow 702 through the maze (see FIG. 7). In this example, the first letter encountered along the maze is the correct answer. Any means for hiding and deciphering the correct answer may be provided, however, and the present invention is in no way limited to these few examples.

The cards of the present invention have a variety of applications, including, but not limited to, the following:

A. Card Games

Because of the similarities between a standard deck of cards and the fifty-two numbered standard cards, virtually any card game one can play with an ordinary deck of cards can be played with the numbered standard cards. In addition to standard card games, the users are encouraged to develop alternative games:

(1) Wildlife Survival (for 2 players)

Object: To be the first player to win all cards from their opponent.

Dealer: Dealer shuffles the cards and deals out 26 cards to each player, one at a time, face down. Do NOT look at your cards. Put them in a face down stack in front of you.

Play: Each player turns over the top card and puts it beside their stack, face up, so that their opponent can see it. One of three situations will occur:

If the two exposed cards are DIFFERENT ANIMALS from DIFFERENT HABITATS, then the player with the higher numbered card wins the "Battle" and collects his opponent's card.

If the two exposed cards are animals from the SAME HABITAT, then the winner of the "Battle" is determined by the FOOD, SHELTER, PREDATOR, and WEATHER emblems on the cards. Although not present on the embodiments shown in FIGS. 1–4, a FOOD, SHELTER, PREDATOR, or WEATHER emblem is preferably located on each card. The hierarchy of the emblems is as follows:

FOOD beats SHELTER and WEATHER

SHELTER beats PREDATOR and WEATHER

PREDATOR beats FOOD

WEATHER beats PREDATOR

If the emblems are the same, then the higher numbered card wins.

If the two exposed cards are the SAME TYPE OF ANIMAL (e.g. Birds) from DIFFERENT HABITATS, then the winner is determined by the FOOD, SHELTER, PREDATOR, and WEATHER emblems at the bottom of each card.

Battle continues until a player wins all the cards from his opponent.

(2) Animal Noises (for 2 or more players)

Object: To win all the cards.

Set up: All players decide what animal they want to be. Make that animal's noise—meow, squeak, and quack, whatever. Each player should choose a different animal. Make sure the other players know what animal they're supposed to be. And remember what animals they are too—you'll need to know. Everyone picks a card from the deck—whoever has the highest card deals.

Dealer: Shuffle the cards. Deal them all out one at a time and face down. It doesn't matter if some people have more cards than others.

All Players: Do NOT look at your cards. Put them in a face down stack in front of you.

Player on dealer's left goes first. Turn over the top card and put it beside your stack, face up, so everyone can see it. Everyone takes a turn with play going around to the left. Each player turns up a card. Keep an eye out for the moment when someone else turns up a card that matches—by number or type of animal—your face up card. You may have a few turns before this happens. As soon as you spot the match, make the other player's animal noise three times in a row. Then take the other player's face up pile and add it to your own face down stack.

If both players spot the match at the same time, the first one to finish making the noises gets the pile.

If you make the wrong noise, you have to give your face up pile to the player with the matching card.

If you run out of cards in your face down stack, just turn over your face up stack and keep going.

The game ends when one person has won all the cards. Winner gathers up the cards and deals next round.

(3) My Kingdom Rules (for 4 to 6 players)

Object: To be the first player to collect seven cards of the same suit (i.e. Habitat)

Set Up: All players pick a card from the deck. Whoever has the highest card deals.

Start: Dealer shuffles the cards and deals out seven cards to each player, one at a time, face down. Put the rest of the deck to one side—you won't be using it again for this game.

All players pick up their cards. Arrange them into Habitats (i.e. suits) so that you can easily see what you have most of. Decide what Habitat to collect. But, be prepared to change your mind during the game. Choose a card that you don't want. Put that card face down in front of you.

Play: All players slide the card you don't want to your left hand neighbor. Pick up the card your right hand neighbor slides to you. Keep on passing and picking up cards, trying to get a hand of cards all of the same Habitat. The first person to have seven cards of the same Habitat shouts "My Kingdom Rules!" and is the winner.

B. Computer Games (CD ROM, Internet, etc)

The cards may also be used with games available on a CD ROM or Internet website specifically designed to be "interactive" with the cards. The game cards may contain special passwords that are encrypted as pictographs (i.e. a picture that denotes a word or phrase), as shown in FIGS. 1–4. The pictographs may, but do not have to be, hidden within the card so that the user first must locate the pictograph before it may be deciphered. The pictographs may act as passwords to permit access by the user to different games and different levels of the games available for play. For example, to move to the next level within a game, the computer may prompt the user to enter the password from the Parrot card (i.e. "sunflower"). If the user does not have the Parrot card, he must obtain it before progressing in this particular game. Therefore, without the correct cards and passwords access to the games is limited. This helps ensure that the users will desire to collect all of the cards to enable access to all games and levels therein. Alternatively, users will seek the cards and corresponding passwords from their peers, thereby, stimulating greater appeal and interest in the game. To add further challenge to the use of passwords for game play, the pictographs may be color coded such that the user may be required to combine, for example, only the "blue" pictographs to form a word or phrase permitting special access to the game. Those skilled in the art will recognize that the pictographs may represent simple or complex words or phrases and can be designed to be age appropriate for any targeted user base.

An example of a computer game that is interactive with the cards involves the user maneuvering through different animal habitats in order to give the user a sense of what it is like to explore nature. Aboard the BIOmobile the user travels to the Mountains, Savannah, Rain Forest, Desert, Ocean, Arctic, and Australian Outback where special Habitat Hosts, such as Peter the Parrot (Rain Forest) and Steve the Salamander (Desert), act as the users' guide. Using a map and compass, the users explore each habitat and learn about how animals feed, move, grow, and use their senses to remain alive. Armed with clues, users must locate certain animals and, with each successful find, earn the needed food and water for their guide. Each habitat may be filled with a plethora of trails containing fun arcade-style games and academic challenges. Secret passwords, available only from the game cards, control access to various levels of the game. New trails become "activated" or accessible after a predetermined level of completion within each habitat or as certain passwords are obtained. As levels are completed, the user may earn stickers, certificates and special photo shoot opportunities with their favorite animals (all available for downloading and printing). To assist in the educational aspect of this game, the program may have a searchable database of animals and facts and multiple hyperlinks. This database may also contain brief photos, sounds and video. Connection to animal-related websites on the world wide web (including links to live CAM shots at various national zoos) provides for an additional learning resource.

The method and system described in these computer applications herein can be embodied in the form of computer-implemented processes and apparatuses for practicing those processes. The present method and system can also be embodied in the form of computer program code containing instructions, embodied in tangible media, such as floppy diskettes, CD-ROMs, hard drives, or any other computer-readable storage medium, wherein, when the computer program code loaded into and executed by a computer, the computer becomes an apparatus for practicing the method and system. The present method and system can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the method and system. When the implementation is on a general-purpose microprocessor, the computer program code segments configure the microprocessor to create specific logic circuits.

The apparatus and method of implementation of card games with a computer may be accomplished using an article of manufacture, computer program product program or program storage device having a computer usable medium having computer readable program code embodied therein for playing a card game. The computer readable program code in the article of manufacture includes a computer readable program code means for interactive card playing. The article of manufacture may additionally include computer readable program code receiving cpded passwords. The article of manufacture may be a complete program within a computer usable medium having computer readable program code means embodied therein for playing a card game. The computer readable program code in the article of manufacture includes computer readable program code for for interactively playing a card game and accepting and responding to encrypted passwords.

Figure 8:
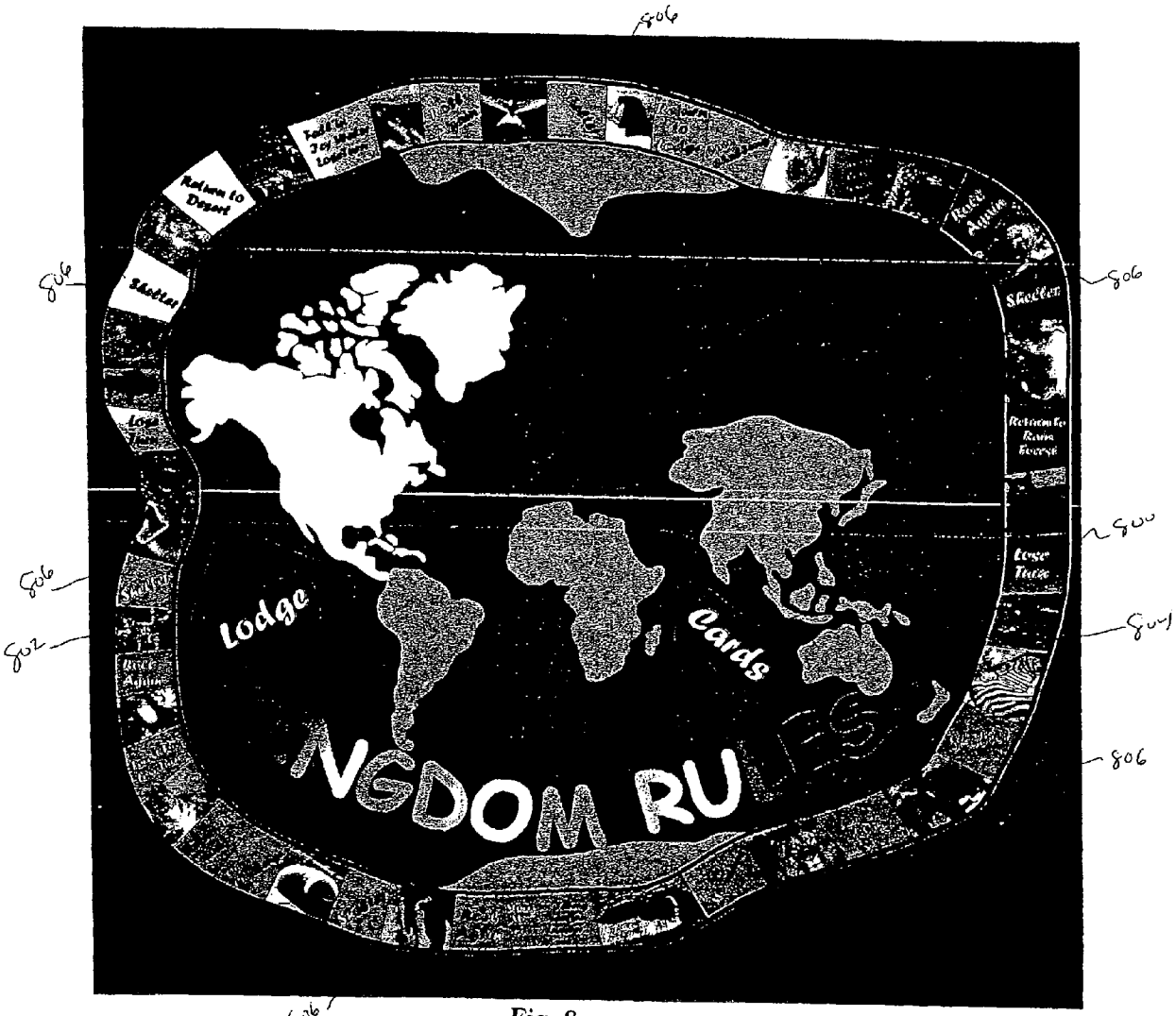
FIG. 8 illustrates a board game embodiment of the invention.

C. Board Game (see FIG. 8)

The cards may also be used in combination with any number of board games 800, an example of which follows:

Object of Game: To Rule the Kingdom by mastering all Four (4) animals in any one Habitat (e.g., Plains, Rain Forest, Mountains, Desert, Arctic, and Antarctic).

Rules:

1. Select game piece (6 colored animal pieces to choose from) and corresponding colored markers that uniquely identify each player. Place game piece at Lodge 802 (located on board).
2. Shuffle the cards and place on designated place on the board 804.
3. Each player turns over a card. Highest goes first.
4. Using the deck of cards, a player must get an EVEN numbered card to Exit the Lodge and Enter a Habitat. Enter any Habitat at the area marked SHELTER 806.
5. Players take turns drawing a card (clockwise order). Move the game piece the number of spaces indicated by the number on the card.
6. Follow written instructions on board.
7. If you land on an animal not already "mastered" by another player (i.e., no colored marker is on the animal), you can attempt to master that animal by "Waging a Battle" against your opponent. (When playing with 3–6 players, wage battles with opponents on your right). If you win the battle, then player places a marker on the space represented by the animal indicating that player is the master of that animal. If you lose the battle, then your turn is over and no marker is placed on the board.
8. If you land on an animal already "mastered" by another player (i.e., a colored marker is on the animal), you must "Wage a Battle" against the opponent who currently is the master of that animal. If you win the battle, then player is allowed to go free on his next turn with no consequences. If you lose the battle, then you must remove one of your markers from the board. If you do not have any markers, then you must return to the Lodge.

Winning: The winner is the first player to master all the animals in any one HABITAT.

To Wage a Battle: Each player in the battle selects a card from the card deck and turns it face up on the board. One of three situations will occur:

A. If the two exposed cards are DIFFERENT ANIMALS from DIFFERENT HABITATS, then the player with the higher numbered card wins the "Battle".

B. If the two exposed cards are animals from the SAME HABITAT, then the winner of the "Battle" is determined by the FOOD, SHELTER, PREDATOR, and WEATHER emblems at the bottom of each card. Note:

FOOD beats SHELTER and WEATHER
SHELTER beats PREDATOR and WEATHER
PREDATOR beats FOOD
WEATHER beats PREDATOR If the emblems are the same, then the higher numbered card wins.

C. If the two exposed cards are the SAME TYPE OF ANIMAL (e.g. Birds) from DIFFERENT HABITATS, then the winner is determined by the FOOD, SHELTER, PREDATOR, and WEATHER emblems at the bottom of each card.

Board Terminology

Return to Lodge—means return game piece to Lodge. As before, player must draw an even numbered card to exit Lodge and return to HABITATS.

Roll Again—take another turn.

Lose Turn—forfeit your next turn.

Open Challenge—Wage a Battle against any other player of your choosing. Loser of the battle must remove one of their markers from the board. The player landing on the OPEN CHALLENGE space can choose not to challenge another player.

Return to Rainforest, Mountains, Desert—means move your game piece to the SHELTER space of that HABITAT D. Trading In addition to the cards' use in conjunction with various games (card games, computer games, board games, etc.) and overall educational appeal, the cards may also be traded. To further enhance the collectability and tradability of the cards, additional features, such as 3-D imaging, holographic imaging, scratch and sniff patches may be added to the cards.

The foregoing is provided for the purpose of illustrating, explaining and describing embodiments of the present invention. Further modifications and adaptations to these embodiments will be apparent to those skilled in the art and may be made without departing from the spirit of the invention or the scope of the following claims.

What is claimed is:

1. A method of playing a card game, comprising: providing: at least one deck of a plurality of playing cards with markings and emblems for different ranking and identification configured to be used in said game; said plurality of playing cards are divided into a plurality of categories; and said plurality of categories is categorized into a common theme, wherein the object is to win all cards from the opponent in a two-player game using the following rules: a dealer shuffling said plurality of cards and dealing alternate cards of said plurality of cards to each player, face down in a stack in front of each player; each player turns over the top card of their stack thus exposing the top card, and puts it beside their stack of cards face up so that their opponent can see it, creating one of three situations; if said exposed cards are from different categories, the player with a higher ranked card wins and collects his opponent's card; if said exposed cards are differently ranked cards from the same category, then said winner is determined by emblems on said cards, said emblems comprising a first emblem, a second emblem, a third emblem, and a fourth emblem, said emblems having a predetermined hierarchy wherein said first emblem beats said second emblem and said third emblem, said second emblem beats said fourth emblem and said third emblem, said fourth emblem beats said first emblem, and said third emblem beats said fourth emblem, a player having a higher emblem collects his opponent's card, if the emblems are the same, then the higher ranked card wins; and said game continues until a player wins all of said plurality of cards from his opponent.

2. The game of claim 1 wherein said common theme is animal habitats, and the plurality of categories include mountains, desert, rain forest, and plains.

3. The game of claim 2 wherein different animals living within that habitat including bald eagle, desert finch, parrot and roadrunner respectively.

4. The game of claim 3 wherein said all cards are numbered so that all cards with a common number represent a specific animal.

5. The game of claim 4 wherein additional cards may contain information additional animals within a habitat or introducing new habitats and highlighting animals living with said additional habitat.

6. The game of claim 1 further comprising: a plurality of fact cards supporting the subject matter of said playing cards.

7. The game of claim 6 further comprising: trivia questions concerning said subject matter.

8. The game of claim 7 wherein answers to said trivia questions are hidden or disguised in a manner requiring deciphering or decoding.

9. The game of claim 8 wherein said answers are a three dimensional image on the card requiring a user to wear 3-D glasses to identify the answer.

10. The game of claim 8 wherein said answers are hidden under a coating that must be scratched off.

11. The game of claim 8 wherein a decoder is used to is used to identify the correct answer.

12. The method of claim 1 further comprising: playing a regular card game with said card game.

13. The method of claim 1 wherein said first emblem is food, said second emblem is shelter, said third emblem is weather, and said fourth emblem is predator, said hierarchy comprises: food beats shelter and weather; shelter beats predator and weather; predator beats food; and weather beats food, wherein if two exposed cards are the same type of animal from different habitats, then the winner is determined by the food, shelter, predator or weather emblems on each card.

14. The method claim of 1 further comprising: wherein the object is to win all said plurality of cards; each player decides what category they want to be and make a sounding mimicking said category; each said player picks up a card from said deck with said player having the highest number deals said plurality one at a time face down; each player places said cards face down in said stack; a first player turns over a top card and puts it beside said stack of face down cards; each player follows in a similar fashion; when a first player turns up a card that matches by number or type of category of a second player, said second player makes said second player's noise three times and said first player takes said second player's face up pile and places them on said first player's face down stack; if both players spot the match, the first player to finish making said category noises gets the pile; if said first player makes an incorrect noise, said first player has to give up his face up card to said second player; if a player runs out of cards in his face down deck, he turns over said face up deck and continues to play; and said game ends when a player has one all said plurality of cards.

15. The method of claim 14 wherein said game cards contain one or more password(s) that are encrypted as pictographs.

16. The method of claim 1 further comprising: at least one deck of a plurality of playing cards with markings configured to be used in said game; said plurality of playing cards divided into a plurality of categories; and said plurality of categories is categorized into a common theme, wherein the object is to win a given number of cards of the same said category from the opponents in a four to six player game using the following rules; determining said dealer by having all players pick a card from said deck with whoever has the highest card dealing; said dealer shuffles said plurality of cards and deals out seven cards to each player, one at a time, face down and placing the rest of said deck aside since the remainder of said deck will be unused fro the remainder of the game; all said players pick up their cards and arrange their cards by category; such as habitats; based upon their card selection each player chooses one card that they don't want face down; each player slides his unwanted card to his neighbor, with all players moving their cards in the same direction, left or right; the game continuers by having each player continue passing an unwanted card until one player has seven cards from the same suit, habitat.

17. The method of claim 16 wherein said game cards contain one or more password(s) that are encrypted as pictographs.

18. The method of claim 1 further comprising playing said card game on a computer with at least one deck of a plurality of playing cards with markings configured to be used in said game; said plurality of playing cards divided into a plurality of categories; and said plurality of categories is categorized into a common theme, wherein the object is to win seven cards of a same suit; at least one deck of a plurality of playing cards with markings configured to be used in said game; said plurality of playing cards divided into a plurality of suits; and said plurality of suits is categorized into a common theme wherein said game cards contain one or more password(s) that are encrypted as pictographs.

19. The method of claim 1 further comprising trading cards each card having a set of cards wherein said cards further comprise one or more of distinctive features such as 3D imaging, holographic imaging or scratch and sniff patches.

20. The method of claim 1 wherein said game cards contain one or more password(s) that are encrypted as pictographs.

* * * * *